US005926082A

United States Patent [19]

Coleman et al.

[11] Patent Number: 5,926,082

[45] **Date of Patent: *Jul. 20, 1999**

[54] SOLENOID STATOR ASSEMBLY

[75] Inventors: Steven B. Coleman, Peoria; Kirk S. Shively, Dunlap, both of Ill.

[73] Assignee: Caterpillar Inc., Peoria, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/992,129

[22] Filed: Dec. 17, 1997

[51] Int. Cl.[6] ..... H01F 3/00

[52] U.S. Cl. ..... 335/260; 335/278; 335/281; 239/88; 239/585.1

[58] Field of Search ..... 335/260, 228, 335/278, 281; 336/96; 264/172.19, 172.2; 239/88, 585.1, 585.5, 585.2, 585.3, 585.4

[56] References Cited

U.S. PATENT DOCUMENTS

| | | | |
|---|---|---|---|
| 2,370,752 | 3/1945 | Ray | 239/88 |
| 5,155,461 | 10/1992 | Teerman et al. | 335/260 |
| 5,339,063 | 8/1994 | Pham | 335/260 |
| 5,370,095 | 12/1994 | Yamaguchi et al. | 123/446 |
| 5,524,825 | 6/1996 | Ueda | 239/88 |

FOREIGN PATENT DOCUMENTS

| | | | |
|---|---|---|---|
| 0 318 177 | 9/1988 | European Pat. Off. | H01F 27/26 |

*Primary Examiner*—Michael L. Gellner
*Assistant Examiner*—Tuyen T. Nguyen
*Attorney, Agent, or Firm*—J. W. Burrows; Mario J. Donato, Jr.

[57] ABSTRACT

The present solenoid stator assembly is adapted to be mounted upon a mounting seat of a fuel injector valve. The assembly includes a housing having an upper end, a lower end, and a base adapted to fit on the mounting seat of the fuel injector valve. A substantially E-shaped stator core is disposed within the housing. The stator core includes a top portion having a first end and a second end. A first outer pole piece depends substantially perpendicularly from the first end, and a second outer pole piece depends substantially perpendicularly from the second end. The central pole piece is located substantially central to the first and second outer pole pieces, and depends substantially perpendicularly from the top portion in a direction substantially parallel to that of the first and second outer pole pieces. The first and second outer pole pieces and the central pole piece each have a distal end forming a face, each face being substantially flush with the base of the housing. A reinforcement band is disposed about the lower end of the housing, and reinforces the housing against expanding cavity pressure developed within the assembly by fuel pressure from within the fuel injector valve.

4 Claims, 2 Drawing Sheets

SOLENOID STATOR ASSEMBLY

TECHNICAL FIELD

This invention relates generally to a solenoid stator assembly, and more particularly, to a solenoid stator assembly for a high pressure electromagnetic solenoid assembly.

BACKGROUND ART

Most engines of trucks commonly used in the trucking industry now utilize fuel injectors to deliver and atomize fuel charge to the engine cylinders. An electronic timing circuit delivers precisely timed electrical pulses for operation of the fuel injector. Such pulses are used in a solenoid stator assembly to reciprocate a solenoid poppet and armature assembly mounted in the fuel injector valve which controls the injection of fuel into the associated engine cylinder.

The solenoid stator assembly commonly requires a housing to protect its electrical components and to locate them precisely in relation to the reciprocating solenoid poppet and armature assembly. Commonly, such housings have involved insulative plastic housing components surrounding a stator core. The stator core extends through a stator coil which is pulsed with the electrical current to generate the magnetic forces necessary to reciprocate the poppet and armature assembly. In the design of such stator assemblies, it is necessary to overcome severe difficulties created by the very harsh working environment in which the assembly must function.

The stator assembly must be able to accommodate wide variations in operating temperature from cold startup at below zero temperatures to under the hood temperatures in hot desert conditions, causing significant thermal expansion and contraction of the housing components. High internal cavity valve pressure from within the injector valve can create high pressure within the interior of the plastic housing leading to cracking of the plastic. Over time and under these conditions of vibration and fluctuating temperature, plastic components of a housing can develop cracks and hairline fractures. Moreover, the plastic housing components can eventually become embrittled. Also, plastic components are at risk of impact damage if persons servicing the engine accidentally impact them with wrenches or other tools during the course of working on adjacent structures. Fuel injectors under current conditions of operations operate at fuel injection pressures on the order of 2,000 pounds per square inch pressure. Fuel under such high working pressures from mechanical portions of the fuel injector valve can direct extremely high pressure of fuel against the plastic stator housing mounting surface. The entry of such fuel between the stator and the insulative plastic housing tends to expand and increase the area and can cause eventual failure of the housing.

Various types of solenoid stator assemblies have been developed to address the aforementioned problems. One such stator assembly is shown in U.S. Pat. No. 5,155,461 to Teerman et al. For "solenoid stator assembly for electronically actuated fuel injectors and method of manufacturing same", owned by Diesel Technology Corporation. The Teerman patent discloses an actuator assembly for use with a fuel injector, the actuator assembly having an E-shaped stator core having outer and central pole pieces received within a plastic housing that is bolted to a mounting base on the fuel injector. To prevent passage of leaking fuel under high pressure between the stator core and the housing, the Teerman device incorporates T-shaped notches in the outer faces of the stator pole pieces into which the plastic material of the housing is molded to present a barrier against the passage of fuel. The Teerman device is constructed by a process which involves prestressing the outer pole pieces of the core outwardly before the housing is molded about it. The prestressing provides restorative forces to oppose additional, fuel pressure related forces that might be applied to the outer pole pieces and inhibit additional displacement.

While the T-shaped slots in the outer pole pieces of the Teerman may be effective to resist fuel migration, it may require an additional machining step to provide such T-shaped slots thereby contributing to the manufacturing cost of the stator core. In addition, the need to prestress the outer pole pieces before molding the housing around the stator core requires additional process steps during the manufacturing process.

The present invention is directed to overcoming one or more of the problems set forth above.

SUMMARY OF THE INVENTION

The present invention is directed toward a solenoid stator assembly adapted to be mounted upon a mounting seat of a fuel injector valve. The assembly includes a housing having an upper end, a lower end, and a base adapted to fit on the mounting seat of the fuel injector valve. A substantially E-shaped stator core is disposed within the housing. The stator core includes a top portion having a first end and a second end. A first outer pole piece depends substantially perpendicularly from the first end, and a second outer pole piece depends substantially perpendicularly from the second end. The central pole piece is located substantially central to the first and second outer pole pieces, and depends substantially perpendicularly from the top portion in a direction substantially parallel to that of the first and second outer pole pieces. The first and second outer pole pieces and the central pole piece each have a distal end forming a face, each face being substantially flush with the base of the housing. A reinforcement band is disposed about the lower end of the housing, and reinforces the housing against expanding cavity pressure developed within the assembly by fuel pressure developed within the fuel injector valve.

These and other aspects and advantages of the present invention will become apparent upon reading the detailed description of the preferred embodiment in connection with the drawings and appended claims.

BRIEF DESCRIPTION OF THE DRAWINGS

For a better understanding of the present invention, reference may be made to the accompanying drawings, in which.

DESCRIPTION OF A PREFERRED EMBODIMENT OF THE INVENTION

Figure 1:
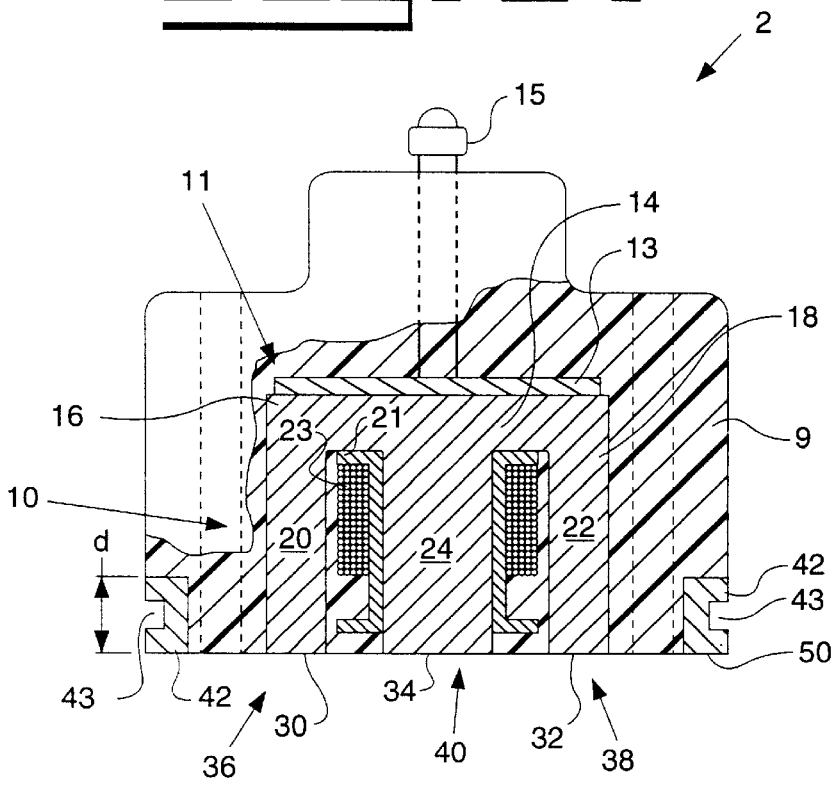
FIG. 1 is a cross sectional side view of an embodiment of the solenoid stator assembly of the present invention.

Referring to the Figures, a solenoid stator assembly according to the present invention, generally designated 2, is shown mounted upon a mounting seat 4 of a fuel injector valve 6. The fuel injector valve 6 includes a solenoid poppet and armature assembly or plunger 8 mounted for reciprocation in the fuel injector valve, in response to electrical pulses from a controller applied to the stator assembly, to control the operation of the fuel injector valve 6. It should be noted that neither the details of the controller nor the fuel injector valve form a part of the present invention.

The solenoid stator assembly includes a housing 9 which houses a stator core 10. In the preferred embodiment, the housing 9 is substantially annular. However, it will be appreciated by those skilled in the art that housing 9 may be of any shape, such as substantially rectangular, substantially elliptical, substantially triangular, etc., and still fall within the scope of the present invention. In the preferred embodiment, housing 9 is made of insulative plastic and is thick enough to be substantially rigid. The stator core 10 generates the magnetic fields that are required to reciprocate the solenoid poppet and armature assembly 8 of the fuel injector valve 6, whereby wire coil 23 is wound upon spool or bobbin 21 extending around center pole piece 24. The provision of an activating electrical current to the wire coil 23 is well known by those skilled in the art.

The stator core 10 is substantially E-shaped, and includes a top portion, generally indicated by reference numeral 14, having a first end 16 and a second end 18. A first outer pole piece 20 extends substantially perpendicularly from the first end 16 of the top portion 14, a second outer pole piece 22 extends substantially perpendicularly from the second end 18 of the top portion 14 in a direction substantially parallel to that of the first outer pole piece 20, and a central pole piece 24 extends from a region of the top portion located central to the first end and second outer pole pieces, 20 and 22, respectively, and in a direction substantially parallel to that of the first and second outer pole pieces 20 and 22.

In the preferred embodiment, the stator core 10 is fabricated from a plurality of identical laminations of magnetizable material. The first and second outer pole pieces 20 and 22 and the central pole piece 24 each have a distal end, generally indicated by reference numbers 30, 32, and 34, respectively, with faces 36, 38, and 40 being formed across respective distal ends 30, 32, and 34. A reinforcement band 42 is disposed about the lower end of housing 9 and extends a predetermined distance "d" upwardly from the base of housing 9. In the preferred embodiment, reinforcement band 42 is in the form of a substantially annular ring. However, it will be appreciated by those skilled in the art that reinforcement band 42 may be of any shape similar to that of housing 9 and still fall within the scope of the present invention.

In the preferred embodiment, reinforcement band 42 is made of metal and is thick enough to be substantially rigid. The insulative housing 9 is molded to the stator core 10 and envelopes the stator assembly except for the faces 36, 38, and 40 of the first and second outer pole pieces and of the central pole piece 20, 22, and 24, respectively. The insulative housing 9 is reinforced by reinforcement band 42 against bulging pressure developed within the stator assembly by fuel cavity pressure developed within the fuel injector valve. In the preferred embodiment, band 42 is "molded in" with undercut 43 to retain position, wherein band 42 is placed in a thermoplastic die located proximate mounting sleeves 52 (FIG. 2) and the exterior surfaces of the housing mold (not shown), as is discussed in greater detail below. The molded in band 42 restrains the insulative housing 9 around the pole pieces 20, 22, and 24, thereby limiting high pressure fluid from penetrating upward along the sides and ends of the pole pieces 20, 22, and 24.

The insulative housing 9 is molded in position by a process which commences with mounting the stator assembly 11 in its desired location by a temporary fixture (not shown). Stator assembly 11 includes stator core 10, carrier 13, wire coil 23, bobbin 21, terminal stud 15, and band 42. The plastic material, in liquid state, is then filled into the spaces between the exterior surfaces of the stator assembly 11 and the interior surface of the mold (not shown) and caused to harden.

Figure 2:
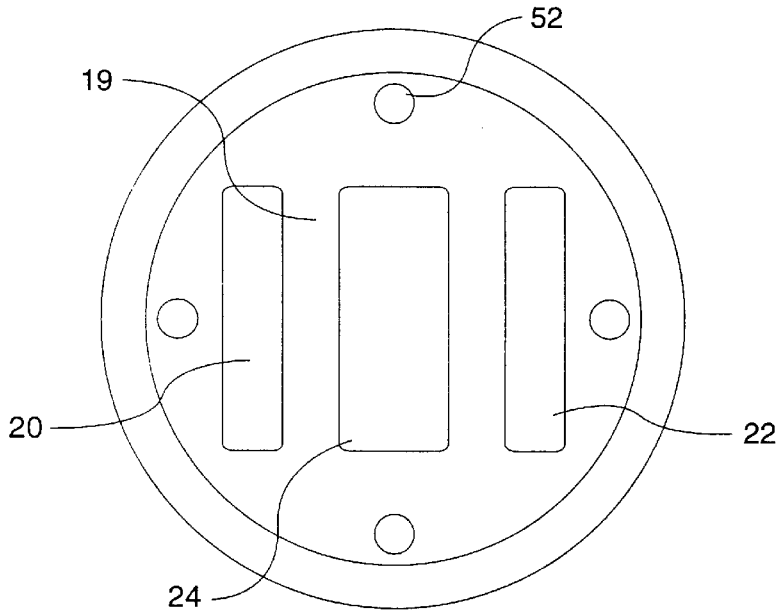
FIG. 2 is a bottom plan view of an embodiment of the solenoid stator assembly of the present invention.
Figure 3:
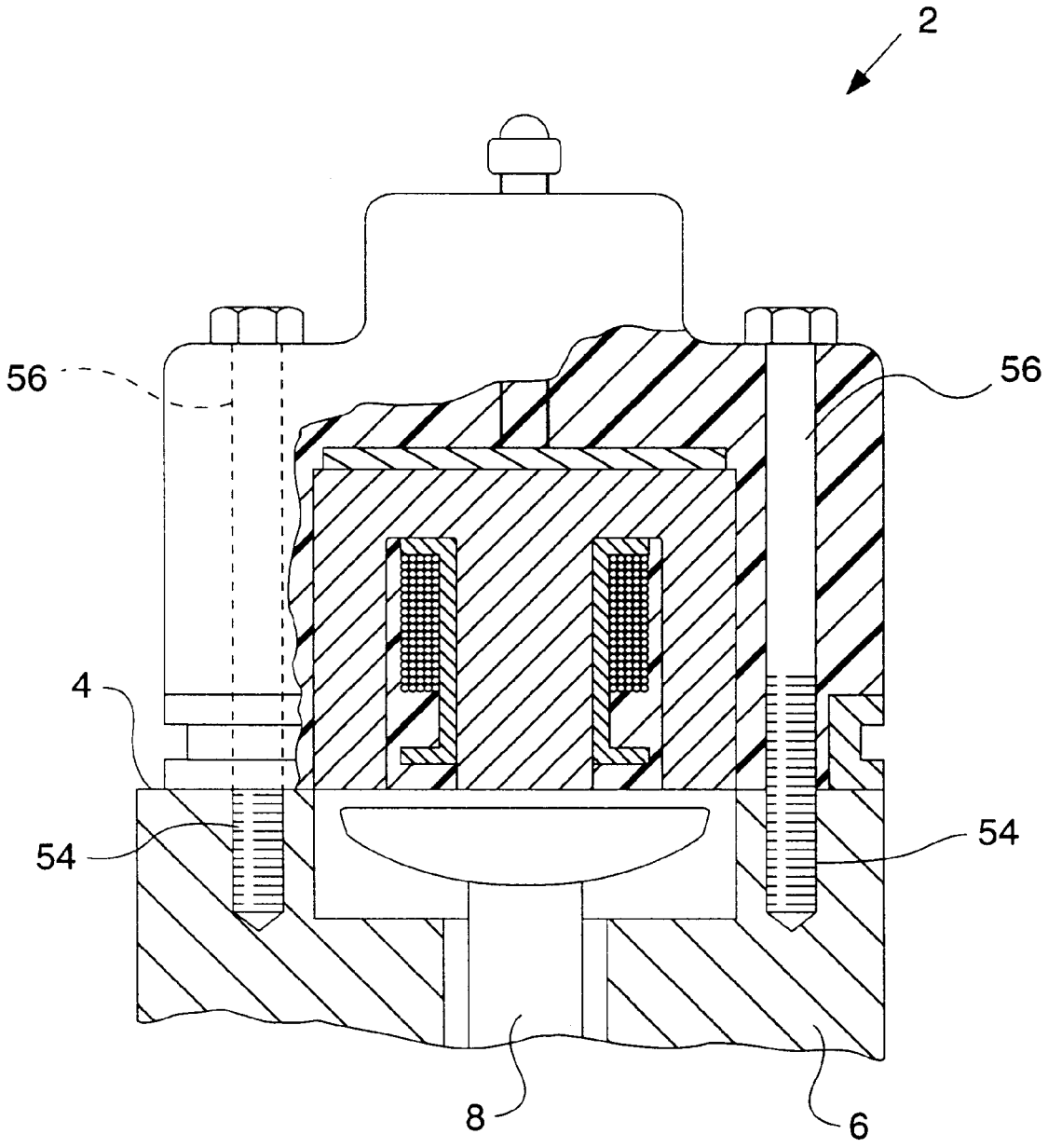
FIG. 3 is a fragmented view of an embodiment of the solenoid stator assembly of the present invention mounted upon a fuel injector valve.

The attachment of the stator assembly to the fuel injector valve is shown in more detail in FIGS. 2 and 3. The insulative housing 9 is provided with four mounting sleeves 52. The positions of the mounting sleeves 52 are chosen to align with the placement of corresponding threaded mounting holes 54 in the body of the fuel injector valve extending downwardly from its mounting seat 4. Securing means 56, such as a bolt, a screw, or the like, extend through the mounting sleeves 52 and are threadedly engaged with the openings 54 to exert the desired clamping force on the housing 9 to secure it flush against the mounting seat 4 of the fuel injector valve 6 and to resiliently squeeze an O-ring mounted in the mounting seat 4 of fuel injector valve 6.

Thus, while the present invention has been particularly shown and described with reference to the preferred embodiment above, it will be understood by those skilled in the art that various additional embodiments may be contemplated without departing from the spirit and scope of the present invention.

We claim:

1. A solenoid stator assembly adapted to be mounted upon a mounting seat of a fuel injector valve, comprising:

an insulative housing having an upper end, a lower end, and a base adapted to fit on the mounting seat of the fuel injector valve, a recess is disposed in the lower end of the insulative housing circumferentially therearound generally adjacent the base;

a substantially E-shaped stator core disposed within the insulative housing, said stator core including a top portion having a first end in-line with a second end, a first outer pole piece depending generally perpendicularly from said first end, a second outer pole piece depending generally perpendicularly from said second end, and a central pole piece depending generally perpendicularly from a region of the top portion located substantially central to the first and second outer pole pieces and in a direction substantially parallel to that of the first and second outer pole pieces, the first and second outer pole pieces and the central pole piece each having a distal end forming a face, each face being substantially flush with the base of the housing; and a reinforcement band circumferentially disposed in the recess;

said insulative housing being molded to said stator core and enveloping the stator assembly except for the faces of the first and second outer pole pieces and of the central pole piece, said lower end of the insulative housing being reinforced by said reinforcement band against expanding cavity pressure developed within the assembly by fuel pressure within the fuel injector valve.

2. A solenoid stator assembly as recited in claim 1, wherein said reinforcement band is integrally formed with said insulative housing.

3. A solenoid stator assembly as recited in claim 2, wherein said reinforcement band is substantially annular.

4. A solenoid stator assembly as recited in claim 1, wherein said insulative housing includes mounting portions operative to receive securing means for securing said insulative housing to said fuel injector valve.

* * * * *